US012221200B2

(12) United States Patent
Yamaguchi

(10) Patent No.: US 12,221,200 B2
(45) Date of Patent: Feb. 11, 2025

(54) MARINE VESSEL MANEUVERING SYSTEM AND MARINE VESSEL

(71) Applicant: YAMAHA HATSUDOKI KABUSHIKI KAISHA, Iwata (JP)

(72) Inventor: Kohei Yamaguchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 499 days.

(21) Appl. No.: 17/833,988

(22) Filed: Jun. 7, 2022

(65) Prior Publication Data

US 2022/0396346 A1 Dec. 15, 2022

(30) Foreign Application Priority Data

Jun. 14, 2021 (JP) ..... 2021-099010

(51) Int. Cl.

| | |
|---|---|
| ***B63H 25/42*** | (2006.01) |
| ***B63H 20/00*** | (2006.01) |
| ***B63H 20/12*** | (2006.01) |
| ***B63H 21/21*** | (2006.01) |

(52) U.S. Cl.

CPC ..... *B63H 25/42* (2013.01); *B63H 20/12* (2013.01); *B63H 21/213* (2013.01); *B63H 2020/003* (2013.01)

(58) Field of Classification Search

CPC .. B63H 25/42; B63H 20/12; B63H 2020/003; B63H 21/213

See application file for complete search history.

(56) References Cited

U.S. PATENT DOCUMENTS 8,589,004 B1 11/2013 Kanno
8,807,059 B1 * 8/2014 Samples ..... B63H 20/20 114/144 R

FOREIGN PATENT DOCUMENTS

JP 2014-073700 A 4/2014

* cited by examiner

*Primary Examiner* — Stephen P Avila
(74) *Attorney, Agent, or Firm* — Keating & Bennett, LLP

(57) ABSTRACT

A marine vessel maneuvering system includes a controller configured or programmed to, when an operator is operated to move a marine vessel forward, perform a forward acceleration assist control to perform a control to generate a forward propulsive force in a propulsion generator of a marine propulsion unit that is not used when the operator is operated to move the marine vessel diagonally forward among three or more marine propulsion units.

20 Claims, 10 Drawing Sheets

MARINE VESSEL MANEUVERING SYSTEM AND MARINE VESSEL

CROSS REFERENCE TO RELATED APPLICATIONS

This application claims the benefit of priority to Japanese Patent Application No. 2021-099010 filed on Jun. 14, 2021. The entire contents of this application are hereby incorporated herein by reference.

BACKGROUND OF THE INVENTION

1. Field of the Invention

The present invention relates to a marine vessel maneuvering system and a marine vessel, and more particularly, the present invention relates to a marine vessel maneuvering system and a marine vessel each including three or more marine propulsion units.

2. Description of the Related Art

A marine vessel maneuvering system including three or more marine propulsion units is known in general. Such a marine vessel maneuvering system is disclosed in Japanese Patent Laid-Open No. 2014-073700, for example.

Japanese Patent Laid-Open No. 2014-073700 discloses a marine vessel maneuvering system including three or more marine propulsion units. In the marine vessel maneuvering system described in Japanese Patent Laid-Open No. 2014-073700, a controller controls the three or more marine propulsion units based on an operation on an operator such that a marine vessel is moved forward and diagonally forward, for example.

Although not described in Japanese Patent Laid-Open No. 2014-073700, in a conventional marine vessel maneuvering system as described in Japanese Patent Laid-Open No. 2014-073700, at least when a marine vessel is moved diagonally forward, some of the three or more marine propulsion units may not be used in order to maintain the right-left balance of the marine vessel. For example, in a marine vessel maneuvering system including three marine propulsion units, a central marine propulsion unit is not used to move a marine vessel forward, to move the marine vessel diagonally forward, or to switch between forward movement and diagonal forward movement, but one or both of portside and starboard marine propulsion units are used. That is, while the marine vessel maneuvering system switches between forward movement and diagonal forward movement of the marine vessel, only one or both of the portside and starboard marine propulsion units are used without using the central marine propulsion unit such that the right-left balance of the marine vessel is maintained. However, the central marine propulsion unit is not used to move the marine vessel forward, and thus in a relatively large (large mass) marine vessel such as one including three or more marine propulsion units, acceleration at the time of moving the marine vessel forward is relatively small. Therefore, it is desired to improve acceleration at the time of moving a marine vessel forward when the marine vessel includes three or more marine propulsion units and some of the marine propulsion units are not used at least to move the marine vessel diagonally forward.

SUMMARY OF THE INVENTION

Preferred embodiments of the present invention provide marine vessel maneuvering systems and marine vessels that each improve acceleration at the time of moving marine vessels forward when the marine vessels include three or more marine propulsion units and some of the marine propulsion units are not used at least to move the marine vessels diagonally forward.

A marine vessel maneuvering system according to a preferred embodiment of the present invention includes three or more marine propulsion units each including a propulsion generator to generate a propulsive force to propel a marine vessel, an operator to receive at least operations to move the marine vessel forward and diagonally forward, and a controller configured or programmed to control the three or more marine propulsion units based on an operation on the operator, and configured or programmed to, when the operator is operated to move the marine vessel forward, perform a forward acceleration assist control to perform a control to generate a forward propulsive force in the propulsion generator of a marine propulsion unit that is not used when the operator is operated to move the marine vessel diagonally forward among the three or more marine propulsion units.

In a marine vessel maneuvering system according to a preferred embodiment of the present invention, the controller is configured or programmed to, when the operator is operated to move the marine vessel forward, perform the forward acceleration assist control to perform a control to generate a forward propulsive force in the propulsion generator of the marine propulsion unit that is not used when the operator is operated to move the marine vessel diagonally forward. Accordingly, the propulsion generator of the marine propulsion unit that is not used when the operator is operated to move the marine vessel diagonally forward assists the forward propulsive forces such that the acceleration of the marine vessel at the time of moving the marine vessel forward is improved. That is, the marine propulsion unit that is not used to maintain the right-left balance of the marine vessel when the marine vessel is moved diagonally forward is used as a marine propulsion unit that assists the forward propulsive forces in the propulsion generators. Furthermore, in the structure including the three or more marine propulsion units, some of the marine propulsion units are not used at least to move the marine vessel diagonally forward such that the right-left balance of the marine vessel is maintained. Therefore, the acceleration at the time of moving the marine vessel forward is improved while the right-left balance of the marine vessel is maintained.

In a marine vessel maneuvering system according to a preferred embodiment of the present invention, the three or more marine propulsion units preferably include a portside marine propulsion unit located on a port side, a starboard marine propulsion unit located on a starboard side, and a central marine propulsion unit located between the portside marine propulsion unit and the starboard marine propulsion unit, and the controller is preferably configured or programmed to perform the forward acceleration assist control to generate a forward propulsive force in the propulsion generator of the central marine propulsion unit that is not used when the operator is operated to move the marine vessel diagonally forward. Accordingly, the central marine propulsion unit is not used to move the marine vessel diagonally forward, but the portside marine propulsion unit and the starboard marine propulsion unit are used, and thus at least when the marine vessel is moved diagonally forward, the right-left balance of the marine vessel is easily maintained.

In a marine vessel maneuvering system according to a preferred embodiment of the present invention, the controller is preferably configured or programmed to perform the forward acceleration assist control to temporarily generate a forward propulsive force in the propulsion generator. Accordingly, after the marine vessel is accelerated in a forward movement direction and reaches a certain speed, the assist of the forward propulsive forces in the propulsion generators that is no longer needed is terminated.

In a marine vessel maneuvering system according to a preferred embodiment of the present invention, the operator preferably includes a joystick, and the controller is preferably configured or programmed to perform the forward acceleration assist control when the joystick is tilted forward. Accordingly, a direction in which the joystick is tilted and a direction in which the marine vessel is moved match as a forward direction, and thus an operation is performed in an intuitively easy-to-understand state to perform the forward acceleration assist control. Furthermore, the joystick is generally operated not only to move the marine vessel forward but also to move the marine vessel diagonally forward in an intuitively easy-to-understand state, and thus the joystick is particularly effective as an "operator" in the structure in which the forward acceleration assist control is performed in connection with the operation to move the marine vessel forward and the operation to move the marine vessel diagonally forward.

In a marine vessel maneuvering system according to a preferred embodiment of the present invention, the controller is preferably configured or programmed to not perform the forward acceleration assist control upon the operator being operated to move the marine vessel forward when the marine vessel is previously moved diagonally forward, and to perform the forward acceleration assist control upon the operator being operated to move the marine vessel forward when a propulsive force of the propulsion generator is previously not generated. Accordingly, when some of the marine propulsion units are not used such that it may be difficult to maintain the right-left balance of the marine vessel, such as when the marine vessel is switched from a diagonal forward movement state to a forward movement state, the forward propulsive forces in the propulsion generators are not assisted such that the difficulty in maintaining the right-left balance of the marine vessel due to not using some of the marine propulsion units is significantly reduced or prevented. Furthermore, when the assist of the forward propulsive forces in the propulsion generators is particularly needed, such as when a state in which the propulsive forces of the propulsion generators are not generated is switched to a state in which the marine vessel is moved forward, the forward propulsive forces in the propulsion generators are effectively assisted.

In such a case, the three or more marine propulsion units preferably include a portside marine propulsion unit located on a port side, a starboard marine propulsion unit located on a starboard side, and a central marine propulsion unit located between the portside marine propulsion unit and the starboard marine propulsion unit, and the controller is preferably configured or programmed to control both the portside marine propulsion unit and the starboard marine propulsion unit to move the marine vessel forward without performing the forward acceleration assist control using the central marine propulsion unit upon the operator being operated to move the marine vessel forward when the marine vessel is moved diagonally forward by either the portside marine propulsion unit or the starboard marine propulsion unit, and to perform the forward acceleration assist control to move the marine vessel forward using the central marine propulsion unit, which is not used when the operator is operated to move the marine vessel diagonally forward, in addition to both the portside marine propulsion unit and the starboard marine propulsion unit upon the operator being operated to move the marine vessel forward when the propulsive force of the propulsion generator is previously not generated. Accordingly, when some of the marine propulsion units are not used such that it may be difficult to maintain the right-left balance of the marine vessel, such as when the marine vessel is switched from the diagonal forward movement state to the forward movement state, the forward propulsive forces in the propulsion generators are not assisted by the central marine propulsion unit and both the portside marine propulsion unit and the starboard marine propulsion unit move the marine vessel forward such that the difficulty in maintaining the right-left balance of the marine vessel due to not using some of the marine propulsion units is easily significantly reduced or prevented. Furthermore, when the assist of the forward propulsive forces in the propulsion generators is particularly needed, such as when a state in which the propulsive forces of the propulsion generators are not generated is switched to a state in which the marine vessel is moved forward, the central marine propulsion unit is added to both the portside marine propulsion unit and the starboard marine propulsion unit such that the forward propulsive forces in the propulsion generators are assisted at the center of the marine vessel in the right-left direction without decreasing the balance of the marine vessel in the right-left direction.

In a marine vessel maneuvering system according to a preferred embodiment of the present invention, the controller is preferably configured or programmed to perform the forward acceleration assist control to gradually decrease a forward propulsive force temporarily generated in the propulsion generator until the forward propulsive force becomes zero. Accordingly, the assist of the forward propulsive forces in the propulsion generators is terminated relatively smoothly, and thus good navigation stability of the marine vessel is maintained as compared with a case in which the temporarily generated propulsive force changes rapidly.

In such a case, the controller is preferably configured or programmed to perform the forward acceleration assist control to gradually decrease the forward propulsive force temporarily generated in the propulsion generator until the forward propulsive force becomes zero after the forward propulsive force is maintained in a constant state for a predetermined first time. Accordingly, good navigation stability of the marine vessel is maintained while the marine vessel is sufficiently accelerated in the forward movement direction until the marine vessel reaches a certain speed before the assist of the forward propulsive forces in the propulsion generators is terminated.

In a marine vessel maneuvering system including the controller configured or programmed to perform the forward acceleration assist control to gradually decrease the forward propulsive force temporarily generated in the propulsion generator until the forward propulsive force becomes zero after the forward propulsive force is maintained in the constant state for the predetermined first time, the controller is preferably configured or programmed to perform the forward acceleration assist control to gradually decrease a forward propulsive force of the propulsion generator operable to temporarily generate the forward propulsive force until the forward propulsive force becomes zero after the forward propulsive force is maintained equal or substantially equal to an average of forward propulsive forces of a plurality of remaining propulsion generators for the predetermined first time. Accordingly, the forward propulsive force temporarily generated in the propulsion generator is set to an appropriate magnitude in accordance with the average of the forward propulsive forces of the plurality of propulsion generators other than the propulsion generator that temporarily generates the forward propulsive force.

In a marine vessel maneuvering system according to a preferred embodiment of the present invention, the propulsion generator of each of the three or more marine propulsion units is preferably driven by an engine. Accordingly, in the structure including the three or more marine propulsion units each including the propulsion generator driven by the engine, some of the marine propulsion units are not used at least to move the marine vessel diagonally forward such that the acceleration at the time of moving the marine vessel forward is improved while the right-left balance of the marine vessel is maintained.

In a marine vessel maneuvering system according to a preferred embodiment of the present invention, the three or more marine propulsion units preferably include five marine propulsion units aligned in a right-left direction of the marine vessel, and the controller is preferably configured or programmed to perform the forward acceleration assist control to generate a forward propulsive force in the propulsion generator of one marine propulsion unit that is located at a center and is not used when the operator is operated to move the marine vessel diagonally forward among the five marine propulsion units. Accordingly, in the large marine vessel including the five marine propulsion units, the acceleration at the time of moving the marine vessel forward is particularly small when the forward propulsive forces in the propulsion generators are not assisted, and thus the structure including the five marine propulsion units is effectively applied to a structure that improves the acceleration at the time of moving the marine vessel forward.

In a marine vessel maneuvering system according to a preferred embodiment of the present invention, the operator is preferably operable to receive an operation to move the marine vessel laterally in addition to the operations to move the marine vessel forward and diagonally forward, and the controller is preferably configured or programmed to perform the forward acceleration assist control to generate a forward propulsive force in the propulsion generator of a marine propulsion unit that is not used when the operator is operated to move the marine vessel diagonally forward and is operable to generate a backward propulsive force in the propulsion generator when the operator is operated to move the marine vessel laterally among the three or more marine propulsion units. In the marine vessel maneuvering system including the three or more marine propulsion units, when the marine vessel is moved laterally, either the portside marine propulsion unit or the starboard marine propulsion unit generates a forward propulsive force in the propulsion generator, and either the starboard marine propulsion unit or the portside marine propulsion unit and the central marine propulsion unit generate backward propulsive forces in the propulsion generator. That is, while lateral movement of the marine vessel is switched to diagonal forward movement of the marine vessel, the forward propulsive force in the propulsion generator of either the portside marine propulsion unit or the starboard marine propulsion unit and the backward propulsive forces in the propulsion generators of either the starboard marine propulsion unit or the portside marine propulsion unit and the central marine propulsion unit are adjusted such that the right-left balance of the marine vessel is maintained. Therefore, with the structure described above, when the marine vessel is moved not only diagonally forward but also laterally, the right-left balance of the marine vessel is maintained. Furthermore, when the marine vessel is moved forward, the marine propulsion unit that is not used to maintain the right-left balance of the marine vessel when the marine vessel is moved diagonally forward and generates a backward propulsive force in the propulsion generator to maintain the balance of the marine vessel when the marine vessel is moved laterally is used as a marine propulsion unit that assists the forward propulsive forces in the propulsion generators.

A marine vessel according to a preferred embodiment of the present invention includes a hull, and three or more marine propulsion units attached to the hull. Each of the three or more marine propulsion units includes a propulsion generator to generate a propulsive force to propel the marine vessel, and the hull includes an operator to receive at least operations to move the marine vessel forward and diagonally forward, and a controller configured or programmed to control the three or more marine propulsion units based on an operation on the operator, and configured or programmed to, when the operator is operated to move the marine vessel forward, perform a forward acceleration assist control to perform a control to generate a forward propulsive force in the propulsion generator of a marine propulsion unit that is not used when the operator is operated to move the marine vessel diagonally forward among the three or more marine propulsion units.

In a marine vessel according to a preferred embodiment of the present invention, the controller is configured or programmed to perform the forward acceleration assist control similar to that of the marine vessel maneuvering system according to preferred embodiments of the present invention described above. Accordingly, similarly to the marine vessel maneuvering system according to preferred embodiments of the present invention described above, the marine propulsion unit that is not used to maintain the right-left balance of the marine vessel when the marine vessel is moved diagonally forward is used as a marine propulsion unit that assists the forward propulsive forces in the propulsion generators. Furthermore, similarly to the marine vessel maneuvering system according to preferred embodiments of the present invention described above, in the structure including the three or more marine propulsion units, some of the marine propulsion units are not used at least to move the marine vessel diagonally forward such that the right-left balance of the marine vessel is maintained. Therefore, the acceleration at the time of moving the marine vessel forward is improved while the right-left balance of the marine vessel is maintained.

In a marine vessel according to a preferred embodiment of the present invention, the three or more marine propulsion units preferably include a portside marine propulsion unit located on a port side, a starboard marine propulsion unit located on a starboard side, and a central marine propulsion unit located between the portside marine propulsion unit and the starboard marine propulsion unit, and the controller is preferably configured or programmed to perform the forward acceleration assist control to generate a forward propulsive force in the propulsion generator of the central marine propulsion unit that is not used when the operator is operated to move the marine vessel diagonally forward. Accordingly, similarly to the marine vessel maneuvering system according to preferred embodiments of the present invention described above, the central marine propulsion unit is not used to move the marine vessel diagonally forward, but the portside marine propulsion unit and the starboard marine propulsion unit are used, and thus at least when the marine vessel is moved diagonally forward, the right-left balance of the marine vessel is easily maintained.

In a marine vessel according to a preferred embodiment of the present invention, the controller is preferably configured or programmed to perform the forward acceleration assist control to temporarily generate a forward propulsive force in the propulsion generator. Accordingly, similarly to the marine vessel maneuvering system according to preferred embodiments of the present invention described above, after the marine vessel is accelerated in a forward movement direction and reaches a certain speed, the assist of the forward propulsive forces in the propulsion generators that is no longer needed is terminated.

In a marine vessel according to a preferred embodiment of the present invention, the operator preferably includes a joystick, and the controller is preferably configured or programmed to perform the forward acceleration assist control when the joystick is tilted forward. Accordingly, similarly to the marine vessel maneuvering system according to preferred embodiments of the present invention described above, a direction in which the joystick is tilted and a direction in which the marine vessel is moved match as a forward direction, and thus an operation is performed in an intuitively easy-to-understand state to perform the forward acceleration assist control. Furthermore, the joystick is generally operated not only to move the marine vessel forward but also to move the marine vessel diagonally forward in an intuitively easy-to-understand state, and thus the joystick is particularly effective as an "operator" in the structure in which the forward acceleration assist control is performed in connection with the operation to move the marine vessel forward and the operation to move the marine vessel diagonally forward.

In a marine vessel according to a preferred embodiment of the present invention, the controller is preferably configured or programmed to not perform the forward acceleration assist control upon the operator being operated to move the marine vessel forward when the marine vessel is previously moved diagonally forward, and to perform the forward acceleration assist control upon the operator being operated to move the marine vessel forward when the marine vessel is stopped. Accordingly, similarly to the marine vessel maneuvering system according to preferred embodiments of the present invention described above, when some of the marine propulsion units are not used such that it may be difficult to maintain the right-left balance of the marine vessel, such as when the marine vessel is switched from a diagonal forward movement state to a forward movement state, the forward propulsive forces in the propulsion generators are not assisted such that the difficulty in maintaining the right-left balance of the marine vessel due to not using some of the marine propulsion units is significantly reduced or prevented. Furthermore, when the assist of the forward propulsive forces in the propulsion generators is particularly needed, such as when a state in which the propulsive forces of the propulsion generators are not generated is switched to a state in which the marine vessel is moved forward, the forward propulsive forces in the propulsion generators are effectively assisted.

In a marine vessel according to a preferred embodiment of the present invention, the controller is preferably configured or programmed to perform the forward acceleration assist control to gradually decrease a forward propulsive force temporarily generated in the propulsion generator until the forward propulsive force becomes zero. Accordingly, similarly to the marine vessel maneuvering system according to preferred embodiments of the present invention described above, the assist of the forward propulsive forces in the propulsion generators is terminated relatively smoothly, and thus good navigation stability of the marine vessel is maintained as compared with a case in which the temporarily generated propulsive force changes rapidly.

In a marine vessel according to a preferred embodiment of the present invention, the three or more marine propulsion units preferably include five marine propulsion units aligned in a right-left direction of the marine vessel, and the controller is preferably configured or programmed to perform the forward acceleration assist control to generate a forward propulsive force in the propulsion generator of one marine propulsion unit that is located at a center and is not used when the operator is operated to move the marine vessel diagonally forward among the five marine propulsion units. Accordingly, similarly to the marine vessel maneuvering system according to preferred embodiments of the present invention described above, in the large marine vessel including the five marine propulsion units, the acceleration at the time of moving the marine vessel forward is particularly small when the forward propulsive forces in the propulsion generators are not assisted, and thus the structure including the five marine propulsion units is effectively applied to a structure that improves the acceleration at the time of moving the marine vessel forward.

In a marine vessel according to a preferred embodiment of the present invention, the operator is preferably operable to receive an operation to move the marine vessel laterally in addition to the operations to move the marine vessel forward and diagonally forward, and the controller is preferably configured or programmed to perform the forward acceleration assist control to generate a forward propulsive force in the propulsion generator of a marine propulsion unit that is not used when the operator is operated to move the marine vessel diagonally forward and is operable to generate a backward propulsive force in the propulsion generator when the operator is operated to move the marine vessel laterally among the three or more marine propulsion units. Accordingly, similarly to the marine vessel maneuvering system according to preferred embodiments of the present invention described above, when the marine vessel is moved not only diagonally forward but also laterally, the right-left balance of the marine vessel is maintained. Furthermore, when the marine vessel is moved forward, the marine propulsion unit that is not used to maintain the right-left balance of the marine vessel when the marine vessel is moved diagonally forward and generates a backward propulsive force in the propulsion generator to maintain the balance of the marine vessel when the marine vessel is moved laterally is used as a marine propulsion unit that assists the forward propulsive forces in the propulsion generators.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel maneuvering system 110 and the structure of a marine vessel 100 according to preferred embodiments of the present invention are now described with reference to FIGS. 1 to 8. The marine vessel maneuvering system 110 maneuvers the marine vessel 100. The marine vessel maneuvering system 110 is provided in the marine vessel 100. In the figures, arrow FWD and arrow BWD represent the front side of and the rear side of the marine vessel 100, respectively.

Figure 1:
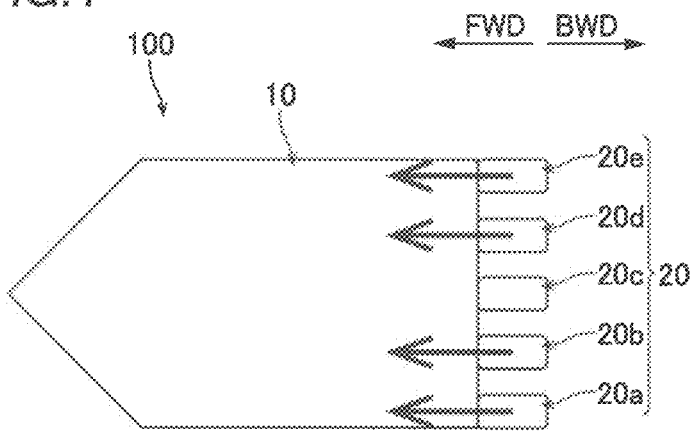
FIG. 1 is a schematic view showing a marine vessel according to a preferred embodiment of the present invention.

As shown in FIG. 1, the marine vessel 100 includes a hull 10 and outboard motors 20. The outboard motors 20 are attached to a rear transom of the hull 10. Three or more outboard motors 20 (for example, five outboard motors 20 in a preferred embodiment of the present invention) are attached to the hull 10. That is, the hull 10 is a relatively large (large mass) hull that requires the thrust of the five outboard motors 20. The outboard motors 20 are examples of a "marine propulsion unit".

The five outboard motors 20 include portside outboard motors 20*a* and 20*b* located on the port side, starboard outboard motors 20*d* and 20*e* located on the starboard side, and a central outboard motor 20*c* located between the portside outboard motor 20*b* and the starboard outboard motor 20*d*. The five outboard motors 20 are aligned in the right-left direction of the marine vessel 100. Specifically, the portside outboard motor 20*a*, the portside outboard motor 20*b*, the central outboard motor 20*c*, the starboard outboard motor 20*d*, and the starboard outboard motor 20*e* are aligned in this order from the port side to the starboard side. The five outboard motors 20 are symmetrically aligned in the right-left direction of the marine vessel 100 with the central outboard motor 20*c* as the center. The portside outboard motors 20*a* and 20*b* are examples of a "portside marine propulsion unit". The starboard outboard motors 20*d* and 20*e* are examples of a "starboard marine propulsion unit". The central outboard motor 20*c* is an example of a "central marine propulsion unit".

Figure 2:
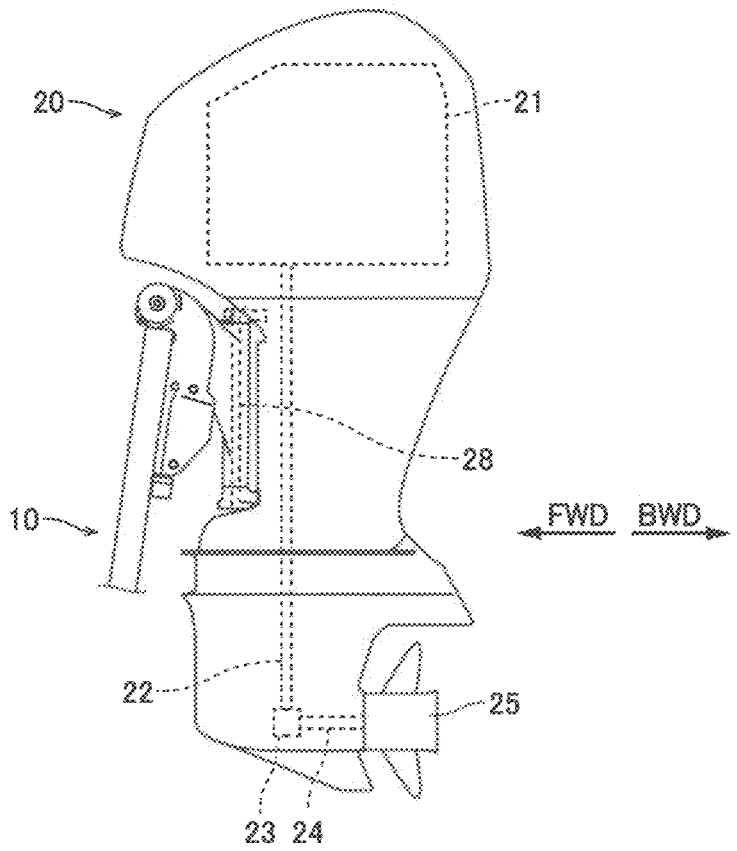
FIG. 2 is a side view showing an outboard motor according to a preferred embodiment of the present invention.

As shown in FIG. 2, each of the five outboard motors 20 includes an engine 21, a drive shaft 22, a gearing 23, a propeller shaft 24, and a propeller 25. The engine 21 is an internal combustion engine that generates a driving force. The driving force of the engine 21 is transmitted to the propeller 25 via the drive shaft 22, the gearing 23, and the propeller shaft 24. The propeller 25 generates a thrust (a propulsive force to propel the marine vessel 100) by rotating in the water by the driving force transmitted from the engine 21. That is, in each of the five outboard motors 20, the propeller 25 is driven by the engine 21. The propeller 25 is an example of a "propulsion generator".

Figure 3:
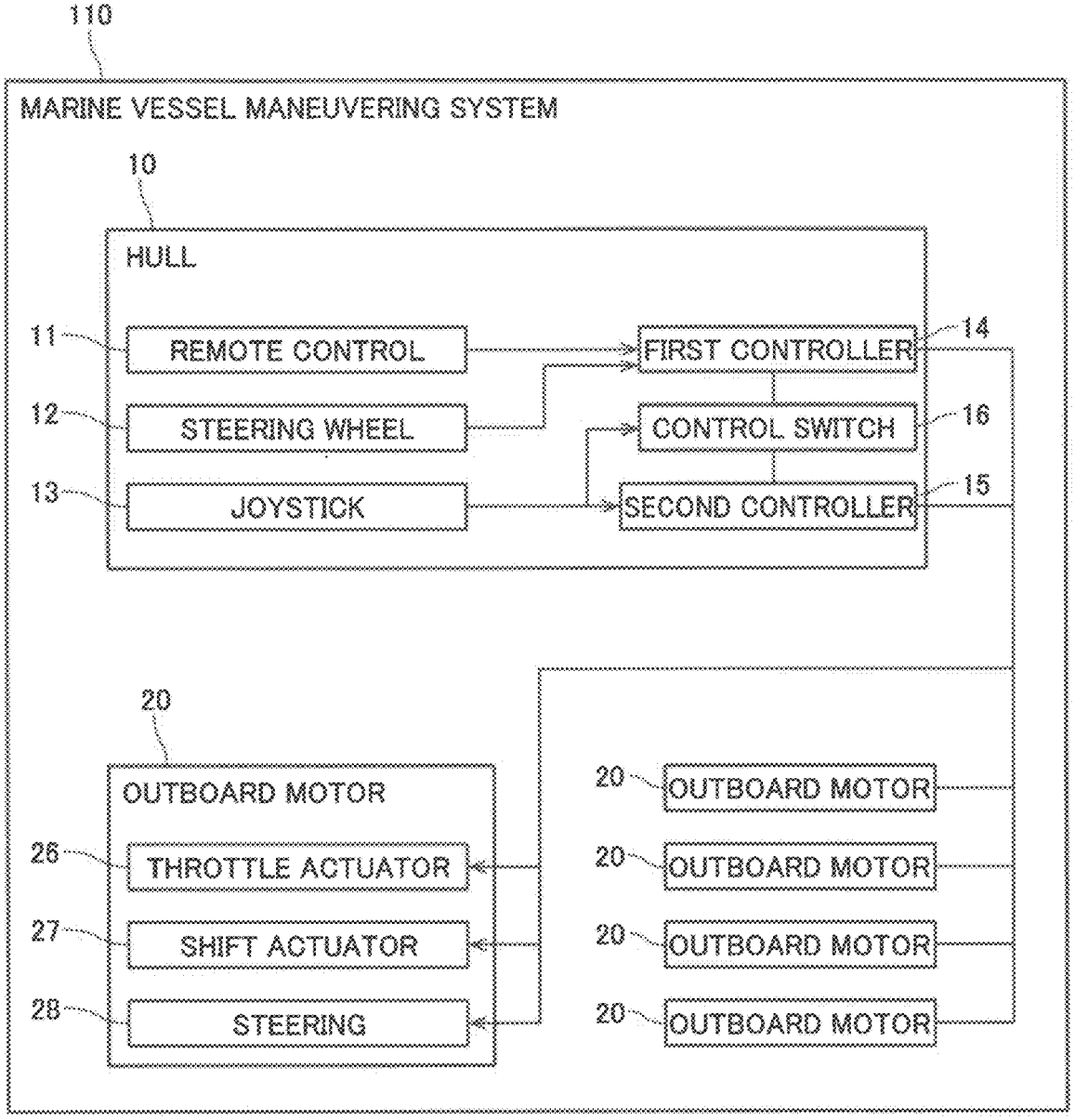
FIG. 3 is a block diagram showing the structure of a marine vessel maneuvering system according to a preferred embodiment of the present invention.

As shown in FIG. 3, each of the five outboard motors 20 includes a throttle actuator 26. The throttle actuator 26 controls the throttle opening degree of the engine 21 (see FIG. 2). Thus, the rotation speed of the engine 21 that drives the propeller 25 is adjusted, and thus the propulsive force of the marine vessel 100 (see FIG. 1) is adjusted.

Each of the five outboard motors 20 includes a shift actuator 27 to switch the shift state. The shift actuator 27 switches between a forward movement state (shift-in state), a backward movement state (shift-in state), and a neutral state (shift-out state) by switching the meshing of the gearing 23 (see FIG. 2). In the forward movement state, a driving force is transmitted from the engine 21 (see FIG. 2) to the propeller 25 to generate a forward propulsive force in the propeller 25 (see FIG. 2). In the backward movement state, a driving force is transmitted from the engine 21 to the propeller 25 to generate a backward propulsive force in the propeller 25. In the neutral state, a driving force is not transmitted from the engine 21 to the propeller 25.

As shown in FIG. 2, each of the five outboard motors 20 includes a steering 28. Each of the outboard motors 20 is rotated in the right-left direction with respect to the hull 10 by the steering 28. Thus, the orientation of the propeller 25 in the right-left direction is adjusted, and thus the direction of the propulsive force is adjusted to propel the hull 10.

As shown in FIG. 3, the hull 10 includes a remote control 11, a steering wheel 12, and a joystick 13 as operators that receive operations to maneuver the marine vessel 100 (see FIG. 1). The joystick 13 is an example of an "operator".

The remote control 11 includes a lever that is operated such that the propulsive force of the propeller 25 (the rotation speed of the propeller 25) is adjusted, and the shift state (the forward movement state, the backward movement state, or the neutral state) is switched. The steering wheel 12 is rotatable, and the steering wheel 12 is rotated such that the orientation of the propeller 25 is adjusted. Thus, an operation on the remote control 11 and an operation on the steering wheel 12 are combined such that the marine vessel 100 (see FIG. 1) is translated (moved forward, backward, laterally, or diagonally while the orientation of the hull 10 (see FIG. 1) is maintained) or is rotated, for example.

Figure 4:
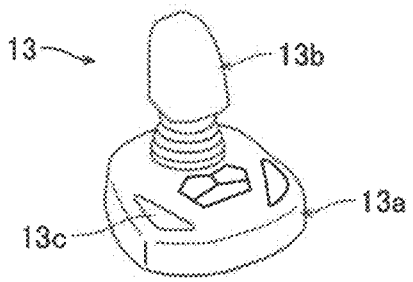
FIG. 4 is a perspective view showing a joystick according to a preferred embodiment of the present invention.

As shown in FIG. 4, the joystick 13 includes a base 13*a* and a lever 13*b*. The lever 13*b* is attached to the base 13*a* so as to be tiltable and rotatable. The lever 13*b* is urged by an urging member such as a spring to automatically return to a neutral position when not operated by a user. At the neutral position, the lever 13*b* is upright and is not rotated.

Operations on the joystick 13 are roughly divided into three operations: an operation to tilt the lever 13*b*, an operation to tilt and rotate the lever 13*b*, and an operation to rotate the lever 13*b*. The joystick 13 receives an operation to translate the marine vessel 100 (see FIG. 1) (move the marine vessel 100 forward, backward, laterally (rightward or leftward), or diagonally (diagonally forward or diagonally backward)), an operation to rotate the marine vessel 100 (right or left), and an operation to turn the marine vessel 100 (right or left).

The operation to tilt the lever 13*b* corresponds to an operation to translate the marine vessel 100 (see FIG. 1). That is, when the lever 13*b* is tilted, the propulsive force (rotation speed) of the propeller 25 (see FIG. 2) is adjusted according to the amount of tilting of the lever 13*b*, and the direction of the propulsive force (the forward movement state or the backward movement state) in the propeller 25 and the orientation of the propeller 25 are adjusted according to the tilting direction of the lever 13*b*.

The operation to tilt and rotate the lever 13*b* corresponds to an operation to rotate the marine vessel 100 (see FIG. 1). That is, when the lever 13*b* is tilted and rotated, the propulsive force (rotation speed) of the propeller 25 (see FIG. 2) is adjusted according to the amount of tilting of the lever 13*b* such that the marine vessel 100 is rotated, and the direction of the propulsive force (the forward movement state or the backward movement state) in the propeller 25 and the orientation of the propeller 25 are adjusted according to the tilting direction, the rotational direction, and the amount of rotation of the lever 13*b*.

The operation to rotate the lever 13*b* corresponds to an operation to turn the marine vessel 100 (see FIG. 1) (change the orientation of the hull 10 (see FIG. 1) on the spot). That is, when the lever 13*b* is rotated, the propulsive force (rotation speed) of the propeller 25 (see FIG. 2) is adjusted according to the amount of rotation of the lever 13*b* such that the marine vessel 100 is turned, and the orientation of the propeller 25 is adjusted according to the rotational direction of the lever 13*b*. In the following description, for convenience of explanation, "the operation to tilt the lever 13*b*" may be referred to as "the operation to tilt the joystick 13".

As shown in FIG. 3, the hull 10 includes a first controller 14, a second controller 15, and a control switch 16. The first controller 14, the second controller 15, and the control switch 16 include circuit boards including a central processing unit (CPU), a read-only memory (ROM), a random access memory (RAM), etc., for example. The second controller 15 is an example of a "controller".

The first controller 14 controls the five outboard motors 20 based on operations on the remote control 11 and the steering wheel 12. Specifically, the first controller 14 controls the throttle actuator 26, the shift actuator 27, and the steering 28 to adjust the propulsive force (rotation speed) of the propeller 25 of each of the five outboard motors 20, switch the shift state of each of the five outboard motors 20, and adjust the orientation of the propeller 25 of each of the five outboard motors 20, respectively, based on the operations on the remote control 11 and the steering wheel 12.

The second controller 15 controls the five outboard motors 20 based on an operation on the joystick 13. Specifically, the second controller 15 controls the throttle actuator 26, the shift actuator 27, and the steering 28 to adjust the propulsive force (rotation speed) of the propeller 25 of each of the five outboard motors 20, switch the shift state of each of the five outboard motors 20, and the orientation of the propeller 25 of each of the five outboard motors 20, respectively, based on the operation on the joystick 13.

The control switch 16 switches between a state in which the first controller 14 controls the five outboard motors 20 and a state in which the second controller 15 controls the five outboard motors 20. Specifically, as shown in FIG. 4, a joystick mode switch 13*c* is provided on the base 13*a* of the joystick 13. The joystick mode switch 13*c* is pressed such that the control switch 16 switches between a state in which an operation on the joystick 13 is received but operations on the remote control 11 and the steering wheel 12 are not received (joystick mode) and a state in which an operation on the joystick 13 is not received but operations on the remote control 11 and the steering wheel 12 are received.

As described above, the hull 10 is a relatively large (large mass) hull, and thus acceleration at the time of moving the marine vessel 100 forward is relatively small (acceleration is relatively slow). Therefore, it is desired to improve the acceleration at the time of moving the marine vessel 100 forward by some method.

Figure 5:
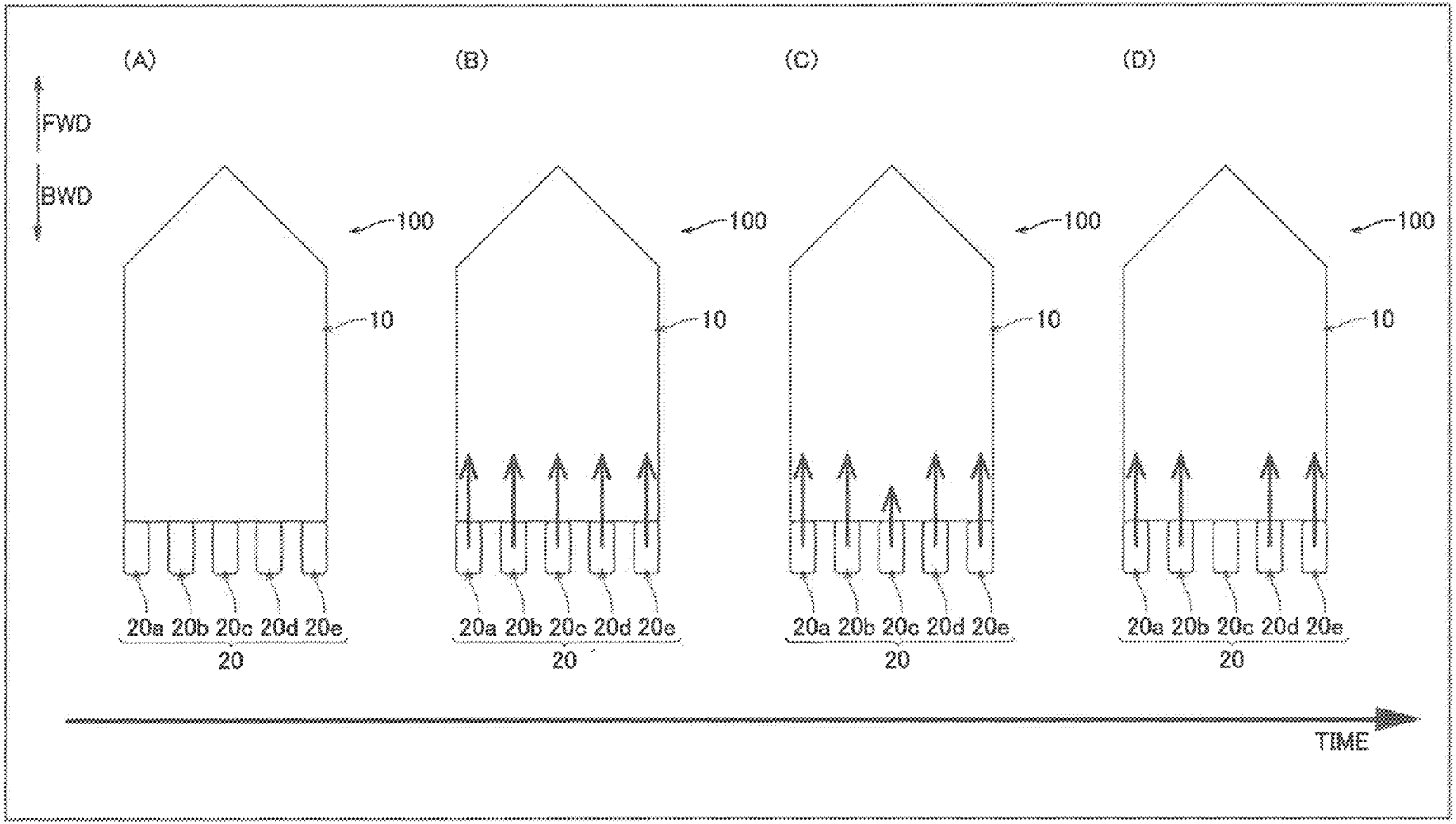
FIG. 5 is a diagram illustrating a forward acceleration assist control in a marine vessel according to a preferred embodiment of the present invention.

Therefore, as shown in FIG. 5, in preferred embodiments of the present invention, the second controller 15 (see FIG. 3) performs a forward acceleration assist control to perform a control to generate a forward propulsive force in the propeller 25 (see FIG. 2) of the central outboard motor 20*c* of the five outboard motors 20 when an operation to move the marine vessel 100 forward (an operation to tilt the joystick 13 forward) is performed on the joystick 13 (see FIG. 4). The central outboard motor 20*c* is not used when the joystick 13 is operated to move the marine vessel 100 diagonally forward, and generates a backward propulsive force in the propeller 25 when the joystick 13 is operated to move the marine vessel 100 laterally. Even when an operation to move the marine vessel 100 forward is performed on the joystick 13, the central outboard motor 20*c* is not used unless conditions to perform the forward acceleration assist control described below are satisfied.

Figure 6A:
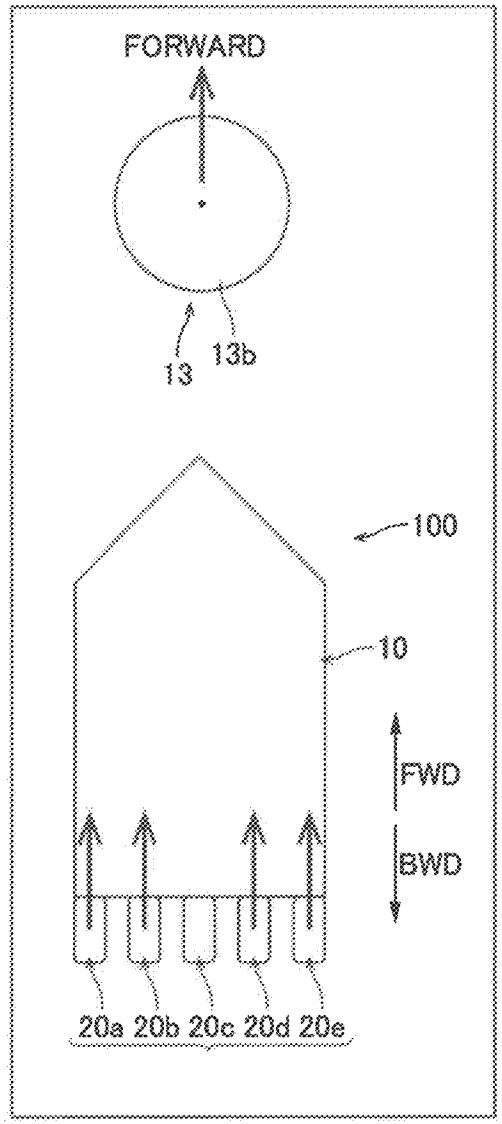
FIG. 6A is a diagram illustrating the forward movement state of a marine vessel according to a preferred embodiment of the present invention.
Figure 6B:
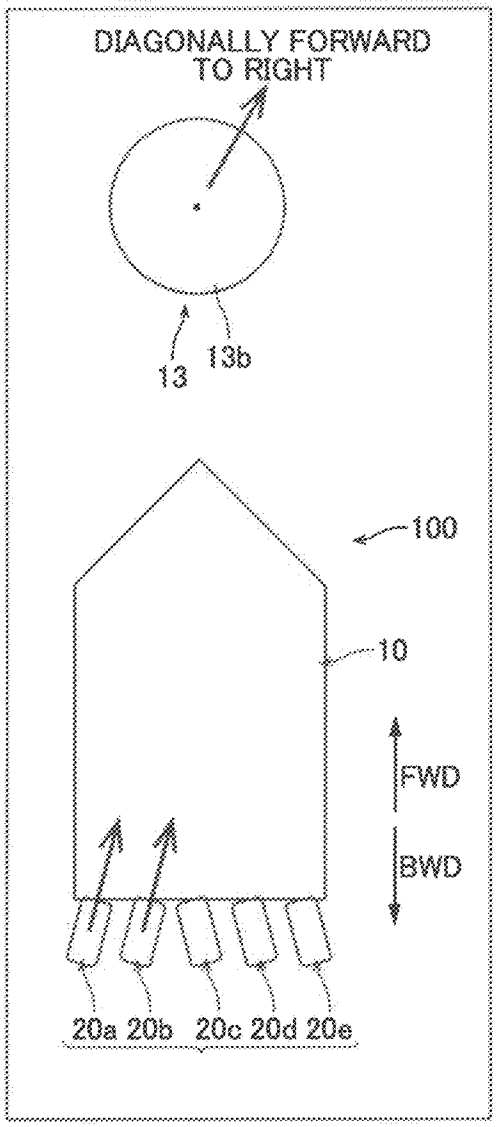
FIG. 6B is a diagram illustrating the diagonal forward movement state of a marine vessel according to a preferred embodiment of the present invention.
Figure 6C:
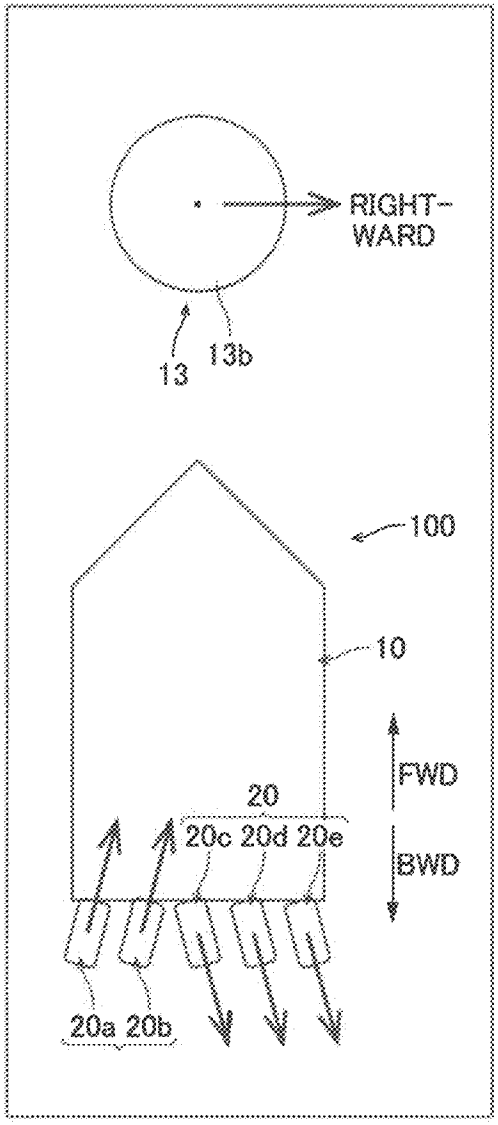
FIG. 6C is a diagram illustrating the lateral movement state of a marine vessel according to a preferred embodiment of the present invention.

Specifically, as shown in FIG. 6A, when the conditions to perform the forward acceleration assist control described below are not satisfied and the marine vessel 100 is moved forward (i.e., when the joystick 13 is tilted forward) (it may be hereinafter referred to as "when the marine vessel 100 is normally moved forward"), the five outboard motors 20 are controlled such that the central outboard motor 20*c* is in the neutral state, and the portside outboard motors 20*a* and 20*b* and the starboard outboard motors 20*d* and 20*e* are in the forward movement state. As shown in FIG. 6B, when the marine vessel 100 is moved diagonally forward (i.e., when the joystick 13 is tilted diagonally forward to the right), the five outboard motors 20 are controlled such that the central outboard motor 20*c* is in the neutral state, either the portside outboard motors 20*a* and 20*b* or the starboard outboard motors 20*d* and 20*e* (the portside outboard motors 20*a* and 20*b* in an example shown in FIG. 6B) are in the forward movement state, and either the starboard outboard motors 20*d* and 20*e* or the portside outboard motors 20*a* and 20*b* (the starboard outboard motors 20*d* and 20*e* in the example shown in FIG. 6B) are in the neutral state. As shown in FIG. 6C, when the marine vessel 100 is moved laterally (i.e., when the joystick 13 is tilted to the right), the five outboard motors 20 are controlled such that either the portside outboard motors 20*a* and 20*b* or the starboard outboard motors 20*d* and 20*e* (the portside outboard motors 20*a* and 20*b* in an example shown in FIG. 6C) are in the forward movement state, and either the starboard outboard motors 20*d* and 20*e* or the portside outboard motors 20*a* and 20*b* (the starboard outboard motors 20*d* and 20*e* in the example shown in FIG. 6C) and the central outboard motor 20*c* are in the backward movement state.

That is, the central outboard motor 20*c* is in the neutral state (i.e., no propulsive force is generated in the propeller 25) when the marine vessel 100 is normally moved forward and when the marine vessel 100 is moved diagonally forward. When the marine vessel 100 is moved laterally, the central outboard motor 20*c* is in the backward movement state (i.e., a backward propulsive force is generated in the propeller 25). FIGS. 6B and 6C show examples in which diagonal forward movement and lateral movement are right diagonal forward movement and right movement, respectively, but when diagonal forward movement and lateral movement are left diagonal forward movement and left movement, respectively, the right and left sides are reversed with respect to the examples shown in FIGS. 6B and 6C.

Figure 7:
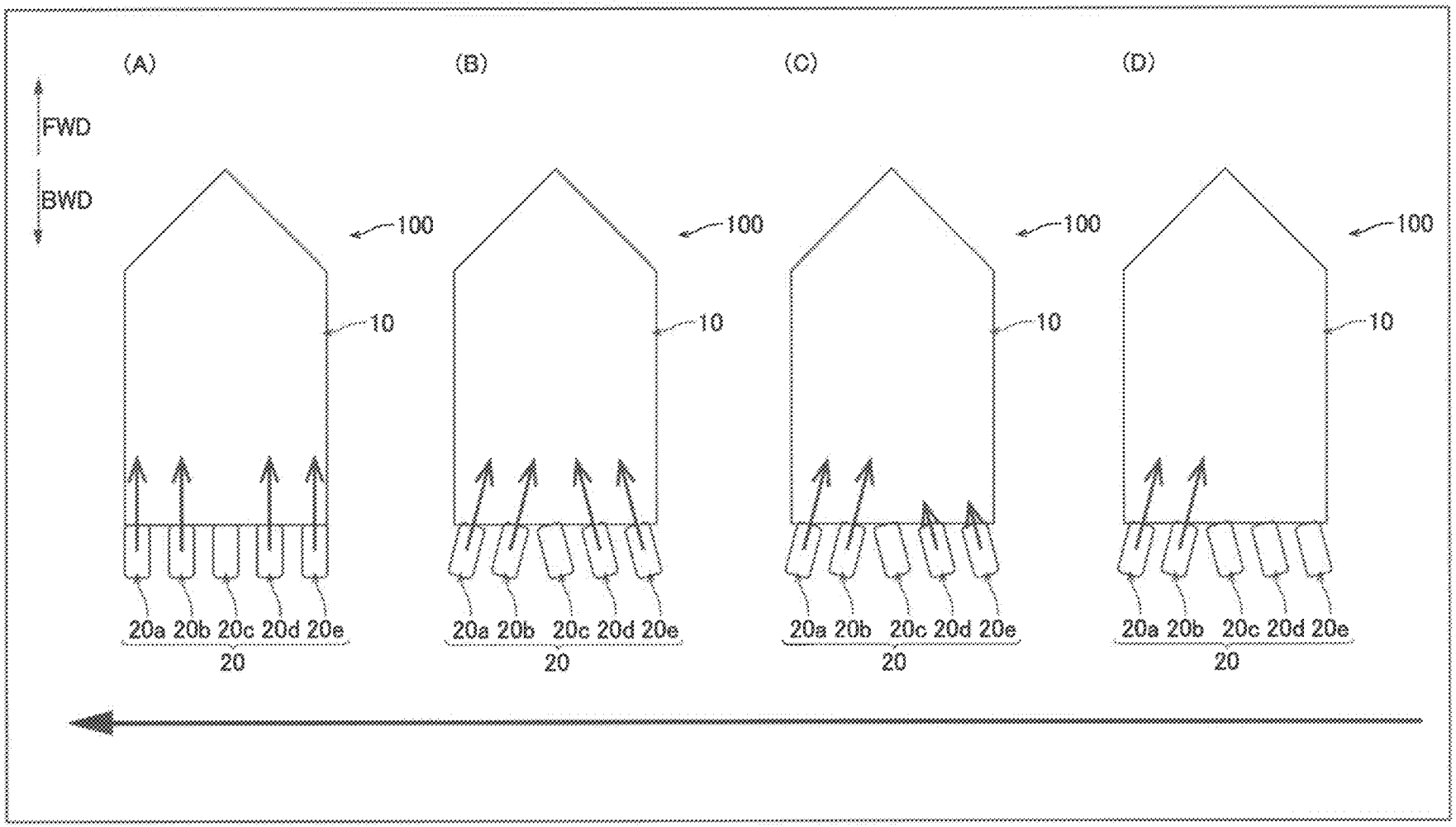
FIG. 7 is a diagram illustrating a state between the forward movement state and the diagonal forward movement state of a marine vessel according to a preferred embodiment of the present invention.
Figure 8:
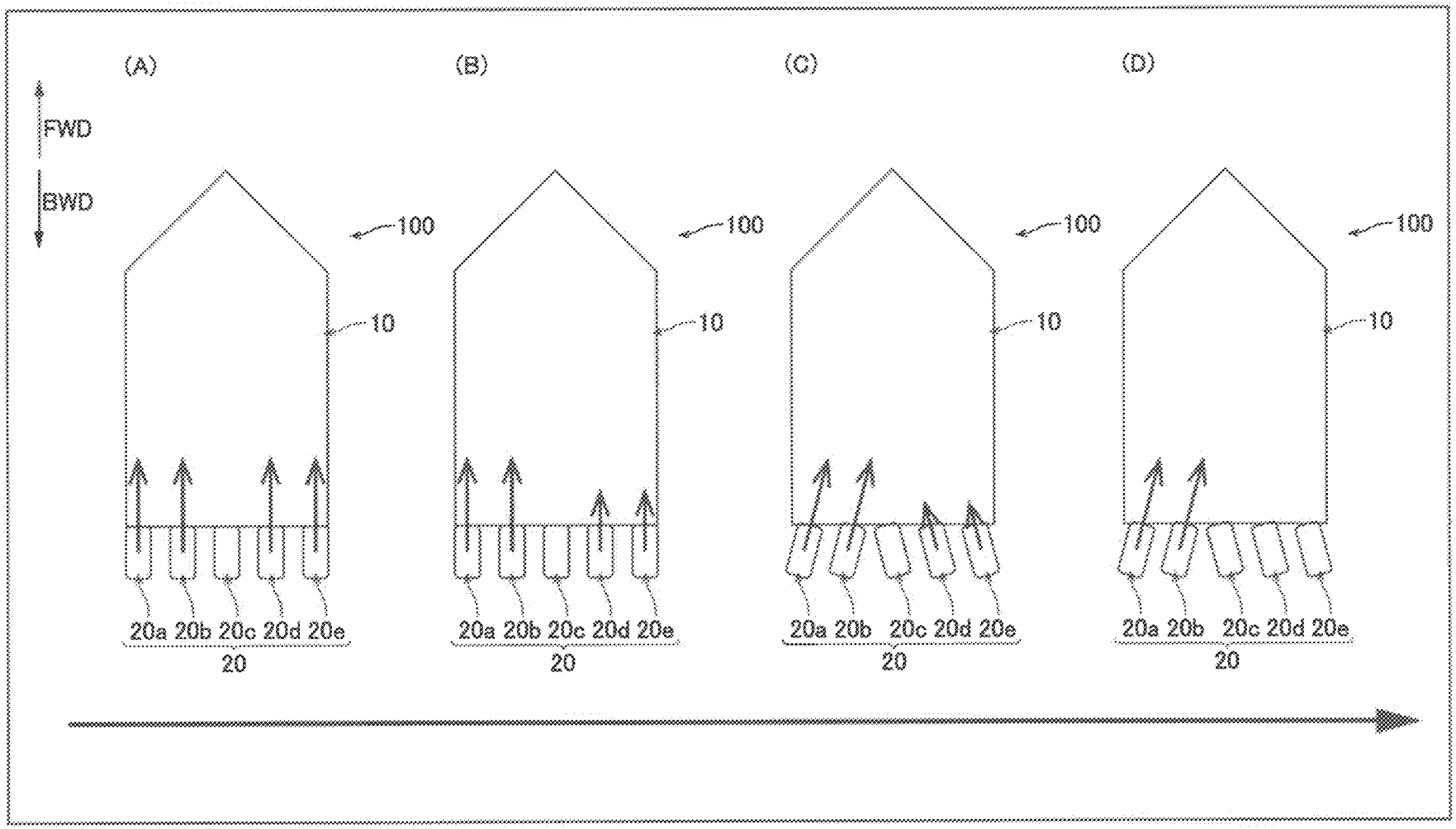
FIG. 8 is a diagram illustrating a state between the diagonal forward movement state and the lateral movement state of a marine vessel according to a preferred embodiment of the present invention.

As shown in FIGS. 7 and 8, in a state (states of FIGS. 7B and 7C and FIGS. 8B and 8C) between a state in which the marine vessel 100 is normally moved forward (states of FIGS. 7A and 8A) and a state in which the marine vessel 100 is moved diagonally forward (states of FIGS. 7D and 8D), the five outboard motors 20 are controlled such that the central outboard motor 20*c* is in the neutral state, and both the portside outboard motors 20*a* and 20*b* and the starboard outboard motors 20*d* and 20*e* are in the forward movement state. That is, in preferred embodiments of the present invention, the second controller 15 controls both the portside outboard motors 20*a* and 20*b* and the starboard outboard motors 20*d* and 20*e* to move the marine vessel 100 forward without performing the forward acceleration assist control described below using the central outboard motor 20*c* upon the joystick 13 being operated to move the marine vessel 100 forward when the marine vessel 100 is moved diagonally forward by either the portside outboard motors 20*a* and 20*b* or the starboard outboard motors 20*d* and 20*e* (see FIG. 7). FIG. 7 shows the states of the five outboard motors 20 when the state in which the marine vessel 100 is moved diagonally forward is changed to the state in which the marine vessel 100 is normally moved forward, and FIG. 8 shows the states of the five outboard motors 20 when the state in which the marine vessel 100 is normally moved forward is changed to the state in which the marine vessel 100 is moved diagonally forward.

Thus, any state between the state in which the marine vessel 100 is normally moved forward and the state in which the marine vessel 100 is moved diagonally forward is achieved by adjusting the balance between the propulsive forces of the portside outboard motors 20*a* and 20*b* and the propulsive forces of the starboard outboard motors 20*d* and 20*e*. That is, the right-left balance of the marine vessel 100 is maintained by adjusting the balance between the propulsive forces of the portside outboard motors 20*a* and 20*b* and the propulsive forces of the starboard outboard motors 20*d* and 20*e*. However, the central outboard motor 20*c* is in the neutral state in many cases when an operation is performed to move the marine vessel 100 forward in order to maintain the right-left balance of the marine vessel 100.

Therefore, as shown in FIGS. 5A and 5B, only when all the five outboard motors 20 are switched from the neutral state (i.e., a state in which the joystick 13 is at the neutral position) to a state in which all the five outboard motors 20 move the marine vessel 100 forward (i.e., a state in which the joystick 13 is tilted forward) (i.e., only under the conditions to perform the forward acceleration assist control), the five outboard motors 20 are controlled such that the central outboard motor 20*c*, which is in the neutral state when the marine vessel 100 is normally moved forward and when the marine vessel 100 is moved diagonally forward, and is in the backward movement state when the marine vessel 100 is moved laterally, is set to the forward movement state and assists the propulsive forces of the portside outboard motors 20*a* and 20*b* and the starboard outboard motors 20*d* and 20*e*, both of which are in the forward movement state. That is, in preferred embodiments of the present invention, the second controller 15 performs the forward acceleration assist control to move the marine vessel 100 forward with the central outboard motor 20*c*, which is not used when the joystick 13 is operated to move the marine vessel 100 diagonally forward, in addition to both the portside outboard motors 20*a* and 20*b* and the starboard outboard motors 20*d* and 20*e* upon the joystick 13 being operated to move the marine vessel 100 forward when the propulsive forces of the propellers 25 are previously not generated. When all of the outboard motors 20 are switched from the neutral state to the state in which all of the outboard motors 20 move the marine vessel 100 forward, the propulsive forces of the portside outboard motors 20*a* and 20*b* and the propulsive forces of the starboard outboard motors 20*d* and 20*e* are evenly generated, and thus the right-left balance of the marine vessel 100 is unlikely to decrease.

In preferred embodiments of the present invention, the second controller 15 (see FIG. 3) performs the forward acceleration assist control to temporarily generate a forward propulsive force in the propeller 25 (see FIG. 2). Specifically, as shown in FIGS. 5A and 5B, the second controller 15 performs the forward acceleration assist control to gradually decrease the forward propulsive force temporarily generated in the propeller 25 in a predetermined second time (in a few seconds to a few tens of seconds, for example) until the forward propulsive force becomes zero after the forward propulsive force is maintained in a constant state (state of FIG. 5B) for a predetermined first time (for a few seconds, for example), as shown in FIGS. 5B, 5C, and 5D. As shown in FIG. 5B, the second controller 15 performs the forward acceleration assist control to gradually decrease the forward propulsive force of the propeller 25 (the propeller 25 of the central outboard motor 20*c*) that temporarily generates the forward propulsive force until the forward propulsive force becomes zero after the forward propulsive force is maintained equal or substantially equal to the average of the forward propulsive forces of a plurality of remaining propellers 25 (the propellers 25 of the portside outboard motors 20*a* and 20*b* and the starboard outboard motors 20*d* and 20*e*) for the first time.

According to the various preferred embodiments of the present invention described above, the following advantageous effects are achieved.

According to a preferred embodiment of the present invention, the second controller 15 is configured or programmed to, when the joystick 13 is operated to move the marine vessel 100 forward, perform a forward acceleration assist control to perform a control to generate a forward propulsive force in the propeller 25 of the outboard motor 20 that is not used when the joystick 13 is operated to move the marine vessel 100 diagonally forward. Accordingly, the propeller 25 of the outboard motor 20 that is not used when the joystick 13 is operated to move the marine vessel 100 diagonally forward assists the forward propulsive forces such that the acceleration of the marine vessel 100 at the time of moving the marine vessel 100 forward is improved. That is, the outboard motor 20 that is not used to maintain the right-left balance of the marine vessel 100 when the marine vessel 100 is moved diagonally forward is used as an outboard motor 20 that assists the forward propulsive forces in the propellers 25. Furthermore, in the structure including three or more outboard motors 20, some of the outboard motors 20 are not used at least to move the marine vessel 100 diagonally forward such that the right-left balance of the marine vessel 100 is maintained. Therefore, the acceleration at the time of moving the marine vessel 100 forward is improved while the right-left balance of the marine vessel 100 is maintained.

According to a preferred embodiment of the present invention, the three or more outboard motors 20 include the portside outboard motors 20*a* and 20*b* located on the port side, the starboard outboard motors 20*d* and 20*e* located on the starboard side, and the central outboard motor 20*c* located between the portside outboard motors 20*a* and 20*b* and the starboard outboard motors 20*d* and 20*e*. Furthermore, the second controller 15 is configured or programmed to perform the forward acceleration assist control to generate a forward propulsive force in the propeller 25 of the central outboard motor 20*c* that is not used when the joystick 13 is operated to move the marine vessel 100 diagonally forward. Accordingly, the central outboard motor 20*c* is not used to move the marine vessel 100 diagonally forward, but the portside outboard motors 20*a* and 20*b* and the starboard outboard motors 20*d* and 20*e* are used, and thus at least when the marine vessel 100 is moved diagonally forward, the right-left balance of the marine vessel 100 is easily maintained.

According to a preferred embodiment of the present invention, the second controller 15 is configured or programmed to perform a forward acceleration assist control to temporarily generate a forward propulsive force in the propeller 25. Accordingly, after the marine vessel 100 is accelerated in a forward movement direction and reaches a certain speed, the assist of the forward propulsive forces in the propellers 25 that is no longer needed is terminated.

According to a preferred embodiment of the present invention, the second controller 15 is configured or programmed to perform a forward acceleration assist control when the joystick 13 is tilted forward. Accordingly, a direction in which the joystick 13 is tilted and a direction in which the marine vessel 100 is moved match as a forward direction, and thus an operation is performed in an intuitively easy-to-understand state to perform the forward acceleration assist control. Furthermore, the joystick 13 is operated not only to move the marine vessel 100 forward but also to move the marine vessel 100 diagonally forward in an intuitively easy-to-understand state, and thus the joystick 13 is particularly effective as an "operator" in the structure in which the forward acceleration assist control is performed in connection with the operation to move the marine vessel 100 forward and the operation to move the marine vessel 100 diagonally forward.

According to a preferred embodiment of the present invention, the second controller 15 is configured or programmed to not perform a forward acceleration assist control upon the joystick 13 being operated to move the marine vessel 100 forward when the marine vessel 100 is previously moved diagonally forward. Furthermore, the second controller 15 is configured or programmed to perform a forward acceleration assist control upon the joystick being operated to move the marine vessel 100 forward when the propulsive forces of the propellers 25 are previously not generated. Accordingly, when some of the outboard motors 20 are not used such that it may be difficult to maintain the right-left balance of the marine vessel 100, such as when the marine vessel 100 is switched from a diagonal forward movement state to a forward movement state, the forward propulsive forces in the propellers 25 are not assisted such that the difficulty in maintaining the right-left balance of the marine vessel 100 due to not using some of the outboard motors 20 is significantly reduced or prevented. Furthermore, when the assist of the forward propulsive forces in the propellers 25 is particularly needed, such as when a state in which the propulsive forces of the propellers 25 are not generated is switched to a state in which the marine vessel 100 is moved forward, the forward propulsive forces in the propellers 25 are effectively assisted.

According to a preferred embodiment of the present invention, the second controller 15 is configured or programmed to control both the portside outboard motors 20*a* and 20*b* and the starboard outboard motors 20*d* and 20*e* to move the marine vessel 100 forward without performing the forward acceleration assist control using the central outboard motor 20*c* upon the joystick 13 being operated to move the marine vessel 100 forward when the marine vessel 100 is moved diagonally forward by either the portside outboard motors 20*a* and 20*b* or the starboard outboard motors 20*d* and 20*e*. Furthermore, the second controller 15 is configured or programmed to perform a forward acceleration assist control to move the marine vessel 100 forward using the central outboard motor 20*c*, which is not used when the joystick 13 is operated to move the marine vessel 100 diagonally forward, in addition to both the portside outboard motors 20*a* and 20*b* and the starboard outboard motors 20*d* and 20*e* upon the joystick 13 being operated to move the marine vessel 100 forward when the propulsive forces of the propellers 25 are not generated. Accordingly, when some of the outboard motors 20 are not used such that it may be difficult to maintain the right-left balance of the marine vessel 100, such as when the marine vessel 100 is switched from the diagonal forward movement state to the forward movement state, the forward propulsive forces in the propellers 25 are not assisted by the central outboard motor 20*c* and both the portside outboard motors 20*a* and 20*b* and the starboard outboard motors 20*d* and 20*e* move the marine vessel 100 forward such that the difficulty in maintaining the right-left balance of the marine vessel 100 due to not using some of the outboard motors 20 is easily significantly reduced or prevented. Furthermore, when the assist of the forward propulsive forces in the propellers 25 is particularly needed, such as when a state in which the propulsive forces of the propellers 25 are not generated is switched to a state in which the marine vessel 100 is moved forward, the central outboard motor 20*c* is added to both the portside outboard motors 20*a* and 20*b* and the starboard outboard motors 20*d* and 20*e* such that the forward propulsive forces in the propellers 25 are assisted at the center of the marine vessel 100 in the right-left direction without decreasing the balance of the marine vessel 100 in the right-left direction.

According to a preferred embodiment of the present invention, the second controller 15 is configured or programmed to perform a forward acceleration assist control to gradually decrease a forward propulsive force temporarily generated in the propeller 25 until the forward propulsive force becomes zero. Accordingly, the assist of the forward propulsive forces in the propellers 25 is terminated relatively smoothly, and thus good navigation stability of the marine vessel 100 is maintained as compared with a case in which the temporarily generated propulsive force changes rapidly.

According to a preferred embodiment of the present invention, the second controller 15 is configured or programmed to perform a forward acceleration assist control to gradually decrease a forward propulsive force temporarily generated in the propeller 25 until the forward propulsive force becomes zero after the forward propulsive force is maintained in a constant state for the predetermined first time. Accordingly, the good navigation stability of the marine vessel 100 is maintained while the marine vessel 100 is sufficiently accelerated in the forward movement direction until the marine vessel 100 reaches a certain speed before the assist of the forward propulsive forces in the propellers 25 is terminated.

According to a preferred embodiment of the present invention, the second controller 15 is configured or programmed to perform a forward acceleration assist control to gradually decrease the forward propulsive force of the propeller 25 operable to temporarily generate the forward propulsive force until the forward propulsive force becomes zero after the forward propulsive force is maintained equal or substantially equal to the average of the forward propulsive forces of the plurality of remaining propellers 25 for the first time. Accordingly, the forward propulsive force temporarily generated in the propeller 25 is set to an appropriate magnitude in accordance with the average of the forward propulsive forces of the plurality of propellers 25 other than the propeller 25 that temporarily generates the forward propulsive force.

According to a preferred embodiment of the present invention, the propeller 25 of each of the three or more outboard motors 20 is driven by the engine 21. Accordingly, in the structure including the three or more outboard motors 20 each including the propeller 25 driven by the engine 21, some of the outboard motors 20 are not used at least to move the marine vessel 100 diagonally forward such that the acceleration at the time of moving the marine vessel 100 forward is improved while the right-left balance of the marine vessel 100 is maintained.

According to a preferred embodiment of the present invention, the marine vessel maneuvering system 110 (marine vessel 100) includes the five outboard motors 20 aligned in the right-left direction of the marine vessel 100. Furthermore, the second controller 15 is configured or programmed to perform the forward acceleration assist control to generate a forward propulsive force in the propeller 25 of one outboard motor 20 (central outboard motor 20*c*) that is located at the center and is not used when the joystick 13 is operated to move the marine vessel 100 diagonally forward among the five outboard motors 20. Accordingly, in the large marine vessel 100 including the five outboard motors 20, the acceleration at the time of moving the marine vessel 100 forward is particularly small when the forward propulsive forces in the propellers 25 are not assisted, and thus the structure including the five outboard motors 20 is effectively applied to a structure that improves the acceleration at the time of moving the marine vessel 100 forward.

According to a preferred embodiment of the present invention, the joystick 13 is operable to receive an operation to move the marine vessel 100 laterally in addition to operations to move the marine vessel 100 forward and diagonally forward. Furthermore, the second controller 15 is configured or programmed to perform a forward acceleration assist control to generate a forward propulsive force in the propeller 25 of the outboard motor 20 that is not used when the joystick 13 is operated to move the marine vessel 100 diagonally forward and is operable to generate a backward propulsive force in the propeller 25 when the joystick 13 is operated to move the marine vessel 100 laterally. Accordingly, when the marine vessel 100 is moved not only diagonally forward but also laterally, the right-left balance of the marine vessel 100 is maintained. Furthermore, when the marine vessel 100 is moved forward, the outboard motor 20 that is not used to maintain the right-left balance of the marine vessel 100 when the marine vessel 100 is moved diagonally forward and generates a backward propulsive force in the propeller 25 to maintain the balance of the marine vessel 100 when the marine vessel 100 is moved laterally is used as an outboard motor 20 that assists the forward propulsive forces in the propellers 25.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the second controller 15 (controller) is preferably configured or programmed to perform a forward acceleration assist control to generate a forward propulsive force in the propeller 25 (propulsion generator) of the outboard motor 20 (marine propulsion unit) that is not used when the joystick 13 (operator) is operated to move the marine vessel 100 diagonally forward and is operable to generate a backward propulsive force in the propeller 25 (propulsion generator) when the joystick 13 (operator) is operated to move the marine vessel 100 laterally in preferred embodiments described above, the present invention is not restricted to this. In the present invention, the controller may alternatively be configured or programmed to perform a forward acceleration assist control to generate a forward propulsive force in the propulsion generator of the marine propulsion unit that is not used when the operator is operated to move the marine vessel diagonally forward and is operable to not generate a backward propulsive force in the propulsion generator when the operator is operated to move the marine vessel laterally.

Figure 9:
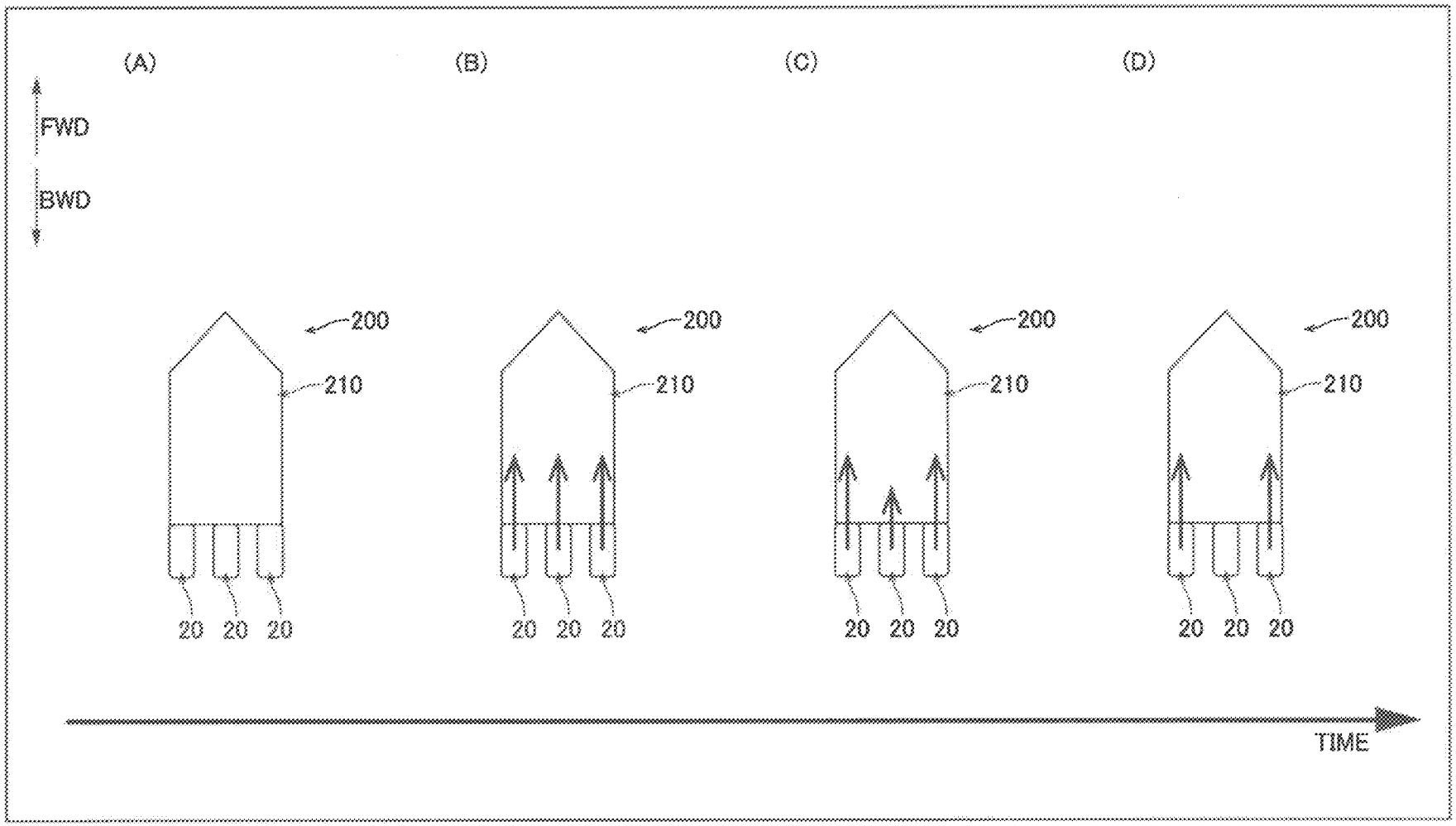
FIG. 9 is a diagram illustrating a forward acceleration assist control in a marine vessel according to a first modified example of a preferred embodiment of the present invention.
Figure 10:
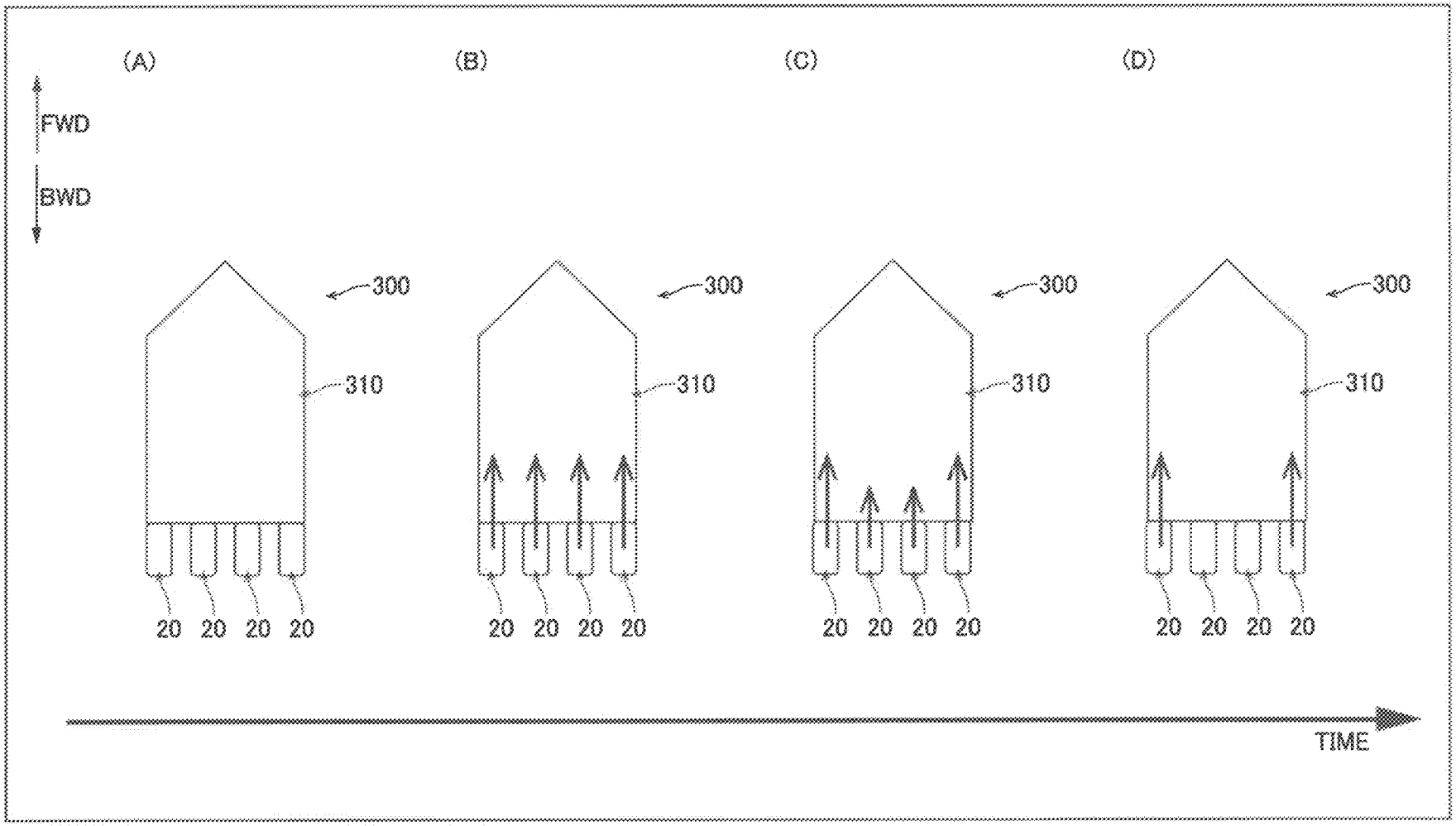
FIG. 10 is a diagram illustrating a forward acceleration assist control in a marine vessel according to a second modified example of a preferred embodiment of the present invention.
Figure 11:
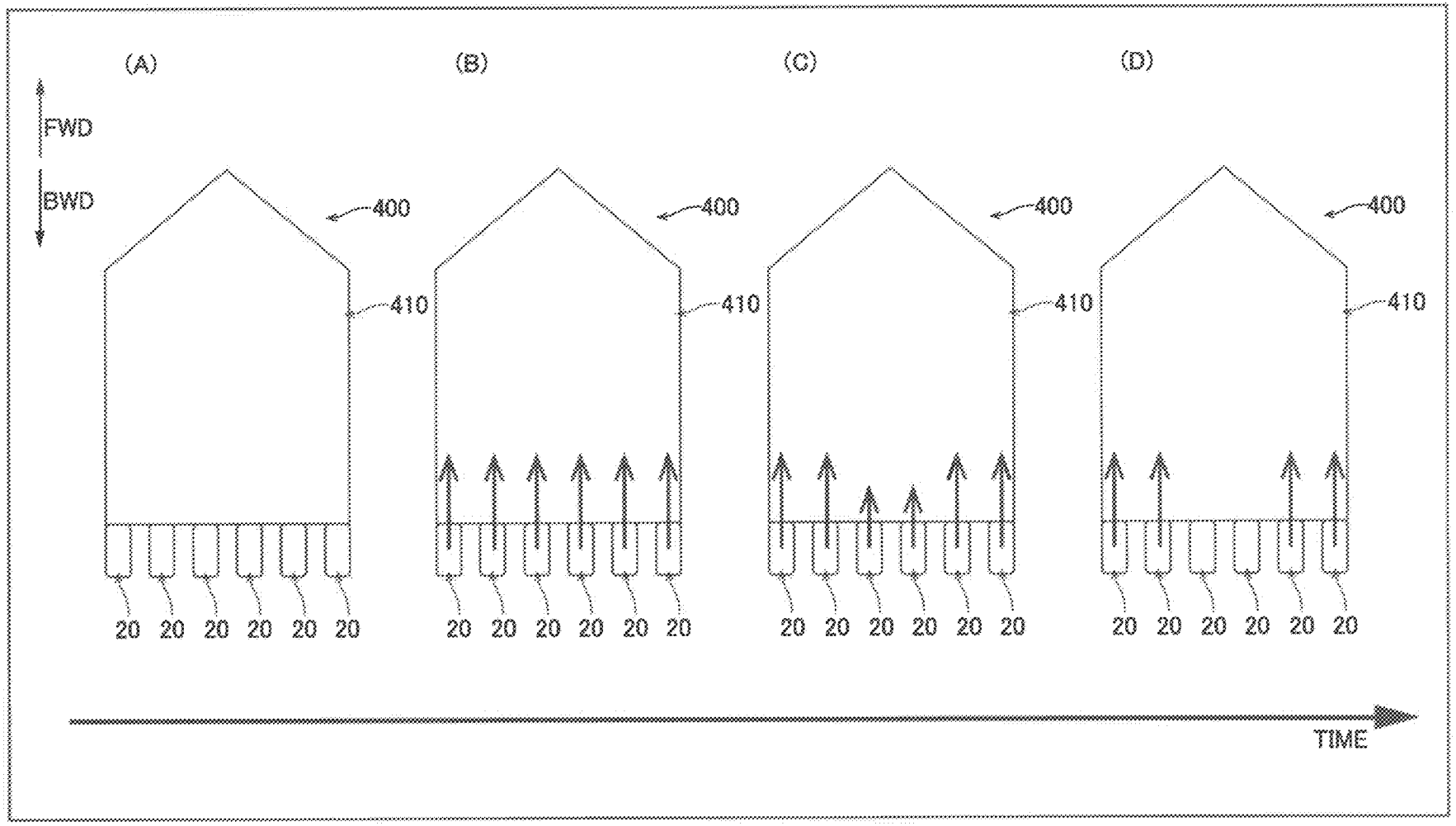
FIG. 11 is a diagram illustrating a forward acceleration assist control in a marine vessel according to a third modified example of a preferred embodiment of the present invention.

While a forward acceleration assist control is preferably performed in the marine vessel 100 including five outboard motors 20 (marine propulsion units) in preferred embodiments described above, the present invention is not restricted to this. In the present invention, for example, as in a first modified example shown in FIG. 9, in a marine vessel 200 including a hull 210 and three outboard motors 20 (marine propulsion units), a forward acceleration assist control may alternatively be performed, as in a second modified example shown in FIG. 10, in a marine vessel 300 including a hull 310 and four outboard motors 20 (marine propulsion units), a forward acceleration assist control may alternatively be performed, as in a third modified example shown in FIG. 11, in a marine vessel 400 including a hull 410 and six outboard motors 20 (marine propulsion units), a forward acceleration assist control may alternatively be performed, or although not shown, in a marine vessel including seven or more marine propulsion units, a forward acceleration assist control may alternatively be performed.

While the propeller 25 (propulsion generator) of each of the three or more outboard motors 20 (marine propulsion units) is preferably driven by the engine 21 in preferred embodiments described above, the present invention is not restricted to this. In the present invention, the propulsion generator of each of the three or more marine propulsion units may alternatively be driven by an electric motor.

While the second controller 15 (controller) is preferably configured or programmed to perform a forward acceleration assist control to gradually decrease the forward propulsive force of the propeller 25 (propulsion generator) that temporarily generates the forward propulsive force until the forward propulsive force becomes zero after the forward propulsive force is maintained equal or substantially equal to the average of the forward propulsive forces of the plurality of remaining propellers 25 (propulsion generators) for the first time in preferred embodiments described above, the present invention is not restricted to this. In the present invention, the controller may alternatively be configured or programmed to perform a forward acceleration assist control to gradually decrease the forward propulsive force of the propulsion generator that temporarily generates the forward propulsive force until the forward propulsive force becomes zero after the forward propulsive force is maintained equal or substantially equal to a propulsive force other than the average of the forward propulsive forces of the plurality of remaining propulsion generators for the first time. Alternatively, the controller may be configured or programmed to perform a forward acceleration assist control to gradually decrease the temporarily generated forward propulsive force until the forward propulsive force becomes zero immediately without maintaining the temporarily generated forward propulsive force in a constant state. Alternatively, the controller may be configured or programmed to perform a forward acceleration assist control to immediately decrease the temporarily generated forward propulsive force until the forward propulsive force becomes zero.

Figure 12:
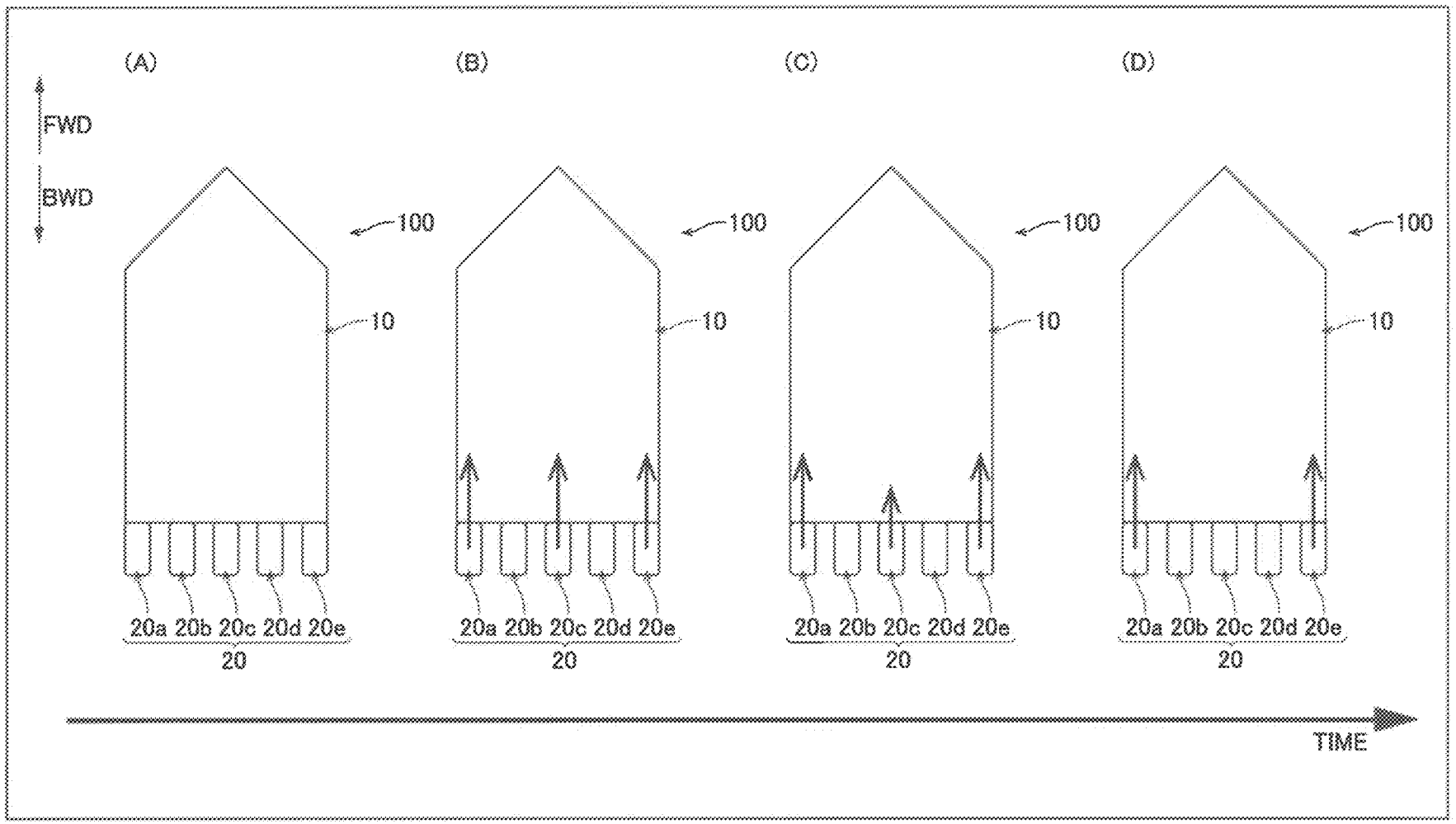
FIG. 12 is a diagram illustrating a forward acceleration assist control in a marine vessel according to a fourth modified example of a preferred embodiment of the present invention.

While when the marine vessel 100 is moved forward or diagonally forward, for example, a set of two portside outboard motors 20*a* and 20*b* (portside marine propulsion units) is preferably used, and a set of two starboard outboard motors 20*d* and 20*e* (starboard marine propulsion units) is preferably used in preferred embodiments described above, the present invention is not restricted to this. In the present invention, as in a fourth modified example shown in FIG. 12, only one of two portside marine propulsion units may alternatively be used, and only one of two starboard marine propulsion units may alternatively be used.

While the second controller 15 (controller) is preferably configured or programmed to not perform a forward acceleration assist control upon the joystick 13 (operator) being operated to move the marine vessel 100 forward when the marine vessel 100 is moved diagonally forward, and to perform a forward acceleration assist control upon the joystick 13 (operator) being operated to move the marine vessel 100 forward when the propulsive forces of the propellers 25 (propulsion generators) are not generated in preferred embodiments described above, the present invention is not restricted to this. In the present invention, the controller may alternatively be configured or programmed to perform a forward acceleration assist control upon the operator being operated to move the marine vessel forward when the marine vessel is moved diagonally forward, or to not perform a forward acceleration assist control upon the operator being operated to move the marine vessel forward when the propulsive forces of the propulsion generators are not generated.

While a joystick is preferably applied as an operator in preferred embodiments described above, the present invention is not restricted to this. In the present invention, any operator other than a joystick may alternatively be applied as an operator as long as the same receives at least operations to move the marine vessel forward and diagonally forward.

While outboard motors are preferably applied as marine propulsion units in preferred embodiments described above, the present invention is not restricted to this. In the present invention, inboard motors or inboard-outboard motors may alternatively be applied as marine propulsion units.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel maneuvering system comprising:

three or more marine propulsion units each including a propulsion generator to generate a propulsive force to propel a marine vessel;

an operator to receive at least operations to move the marine vessel forward and diagonally forward; and a controller configured or programmed to control the three or more marine propulsion units based on an operation on the operator, and configured or programmed to, when the operator is operated to move the marine vessel forward, perform a forward acceleration assist control to perform a control to generate a forward propulsive force in the propulsion generator of a marine propulsion unit that is not used when the operator is operated to move the marine vessel diagonally forward among the three or more marine propulsion units.

2. The marine vessel maneuvering system according to claim 1, wherein the three or more marine propulsion units include a portside marine propulsion unit located on a port side, a starboard marine propulsion unit located on a starboard side, and a central marine propulsion unit located between the portside marine propulsion unit and the starboard marine propulsion unit; and the controller is configured or programmed to perform the forward acceleration assist control to generate a forward propulsive force in the propulsion generator of the central marine propulsion unit that is not used when the operator is operated to move the marine vessel diagonally forward.

3. The marine vessel maneuvering system according to claim 1, wherein the controller is configured or programmed to perform the forward acceleration assist control to temporarily generate a forward propulsive force in the propulsion generator.

4. The marine vessel maneuvering system according to claim 1, wherein the operator includes a joystick; and the controller is configured or programmed to perform the forward acceleration assist control when the joystick is tilted forward.

5. The marine vessel maneuvering system according to claim 1, wherein the controller is configured or programmed to:

not perform the forward acceleration assist control upon the operator being operated to move the marine vessel forward when the marine vessel is previously moved diagonally forward; and perform the forward acceleration assist control upon the operator being operated to move the marine vessel forward when a propulsive force of the propulsion generator is previously not generated.

6. The marine vessel maneuvering system according to claim 5, wherein the three or more marine propulsion units include a portside marine propulsion unit located on a port side, a starboard marine propulsion unit located on a starboard side, and a central marine propulsion unit located between the portside marine propulsion unit and the starboard marine propulsion unit; and the controller is configured or programmed to:

control both the portside marine propulsion unit and the starboard marine propulsion unit to move the marine vessel forward without performing the forward acceleration assist control using the central marine propulsion unit upon the operator being operated to move the marine vessel forward when the marine vessel is previously moved diagonally forward by either the portside marine propulsion unit or the starboard marine propulsion unit; and perform the forward acceleration assist control to move the marine vessel forward using the central marine propulsion unit, which is not used when the operator is operated to move the marine vessel diagonally forward, in addition to both the portside marine propulsion unit and the starboard marine propulsion unit upon the operator being operated to move the marine vessel forward when the propulsive force of the propulsion generator is previously not generated.

7. The marine vessel maneuvering system according to claim 1, wherein the controller is configured or programmed to perform the forward acceleration assist control to gradually decrease a forward propulsive force temporarily generated in the propulsion generator until the forward propulsive force becomes zero.

8. The marine vessel maneuvering system according to claim 7, wherein the controller is configured or programmed to perform the forward acceleration assist control to gradually decrease the forward propulsive force temporarily generated in the propulsion generator until the forward propulsive force becomes zero after the forward propulsive force is maintained in a constant state for a predetermined first time.

9. The marine vessel maneuvering system according to claim 8, wherein the controller is configured or programmed to perform the forward acceleration assist control to gradually decrease a forward propulsive force of the propulsion generator operable to temporarily generate the forward propulsive force until the forward propulsive force becomes zero after the forward propulsive force is maintained equal or substantially equal to an average of forward propulsive forces of a plurality of remaining propulsion generators for the predetermined first time.

10. The marine vessel maneuvering system according to claim 1, wherein the propulsion generator of each of the three or more marine propulsion units is driven by an engine.

11. The marine vessel maneuvering system according to claim 10, wherein the three or more marine propulsion units include five marine propulsion units aligned in a right-left direction of the marine vessel; and the controller is configured or programmed to perform the forward acceleration assist control to generate a forward propulsive force in the propulsion generator of one marine propulsion unit that is located at a center and is not used when the operator is operated to move the marine vessel diagonally forward among the five marine propulsion units.

12. The marine vessel maneuvering system according to claim 1, wherein the operator is operable to receive an operation to move the marine vessel laterally in addition to the operations to move the marine vessel forward and diagonally forward; and the controller is configured or programmed to perform the forward acceleration assist control to generate a forward propulsive force in the propulsion generator of a marine propulsion unit that is not used when the operator is operated to move the marine vessel diagonally forward and is operable to generate a backward propulsive force in the propulsion generator when the operator is operated to move the marine vessel laterally among the three or more marine propulsion units.

13. A marine vessel comprising:

a hull; and three or more marine propulsion units attached to the hull; wherein each of the three or more marine propulsion units includes a propulsion generator to generate a propulsive force to propel the marine vessel;

the hull includes:

an operator to receive at least operations to move the marine vessel forward and diagonally forward; and a controller configured or programmed to control the three or more marine propulsion units based on an operation on the operator, and configured or programmed to, when the operator is operated to move the marine vessel forward, perform a forward acceleration assist control to perform a control to generate a forward propulsive force in the propulsion generator of a marine propulsion unit that is not used when the operator is operated to move the marine vessel diagonally forward among the three or more marine propulsion units.

14. The marine vessel according to claim 13, wherein the three or more marine propulsion units include a portside marine propulsion unit located on a port side, a starboard marine propulsion unit located on a starboard side, and a central marine propulsion unit located between the portside marine propulsion unit and the starboard marine propulsion unit; and the controller is configured or programmed to perform the forward acceleration assist control to generate a forward propulsive force in the propulsion generator of the central marine propulsion unit that is not used when the operator is operated to move the marine vessel diagonally forward.

15. The marine vessel according to claim 13, wherein the controller is configured or programmed to perform the forward acceleration assist control to temporarily generate a forward propulsive force in the propulsion generator.

16. The marine vessel according to claim 13, wherein the operator includes a joystick; and the controller is configured or programmed to perform the forward acceleration assist control when the joystick is tilted forward.

17. The marine vessel according to claim 13, wherein the controller is configured or programmed to:

not perform the forward acceleration assist control upon the operator being operated to move the marine vessel forward when the marine vessel is previously moved diagonally forward; and perform the forward acceleration assist control upon the operator being operated to move the marine vessel forward when a propulsive force of the propulsion generator is previously not generated.

18. The marine vessel according to claim 13, wherein the controller is configured or programmed to perform the forward acceleration assist control to gradually decrease a forward propulsive force temporarily generated in the propulsion generator until the forward propulsive force becomes zero.

19. The marine vessel according to claim 13, wherein the three or more marine propulsion units include five marine propulsion units aligned in a right-left direction of the marine vessel; and the controller is configured or programmed to perform the forward acceleration assist control to generate a forward propulsive force in the propulsion generator of one marine propulsion unit that is located at a center and is not used when the operator is operated to move the marine vessel diagonally forward among the five marine propulsion units.

20. The marine vessel according to claim 13, wherein the operator is operable to receive an operation to move the marine vessel laterally in addition to the operations to move the marine vessel forward and diagonally forward; and the controller is configured or programmed to perform the forward acceleration assist control to generate a forward propulsive force in the propulsion generator of a marine propulsion unit that is not used when the operator is operated to move the marine vessel diagonally forward and is operable to generate a backward propulsive force in the propulsion generator when the operator is operated to move the marine vessel laterally among the three or more marine propulsion units.

* * * * *